United States Patent [19]

Stewart et al.

[11] Patent Number: 4,565,203

[45] Date of Patent: Jan. 21, 1986

[54] APPARATUS FOR CONVEYING CIGARETTE-FILLED TRAYS TO A CIGARETTE-PACKAGING MACHINE

[75] Inventors: Iain G. H. Stewart, Wuppertal; Hans P. Pitz; Alfred Brinker, both of Gevelsberg, all of Fed. Rep. of Germany

[73] Assignee: Maschinenfabrik Fr. Niepmann GmbH & Co., Gevelsberg, Fed. Rep. of Germany

[21] Appl. No.: 550,766

[22] Filed: Nov. 10, 1983

[30] Foreign Application Priority Data

Nov. 10, 1982 [DE] Fed. Rep. of Germany ..... 3241558

[51] Int. Cl.[4] ..... A24C 5/354; A24C 5/356

[52] U.S. Cl. ..... 131/283; 53/236

[58] Field of Search ..... 131/282, 283; 53/148, 53/236; 198/471, 403, 404; 104/1 B, 118, 139, 140, 288

[56] References Cited

U.S. PATENT DOCUMENTS

| | | | |
|---|---|---|---|
| 4,079,575 | 3/1978 | Focke et al. | 53/148 |
| 4,085,759 | 4/1978 | Seragnoli | 131/283 |
| 4,181,212 | 1/1980 | Hinchcliffe | 53/148 |

FOREIGN PATENT DOCUMENTS

| | | |
|---|---|---|
| 1481364 | 2/1969 | Fed. Rep. of Germany . |
| 2018442 | 10/1971 | Fed. Rep. of Germany . |
| 2107825 | 7/1972 | Fed. Rep. of Germany . |
| 1548868 | 10/1968 | France . |

*Primary Examiner*—V. Millin
*Assistant Examiner*—H. Macey
*Attorney, Agent, or Firm*—Becker & Becker, Inc.

[57] ABSTRACT

An apparatus for conveying cigarette-filled trays from at least one tray-filling device to the hopper of at least one cigarette-packaging machine, and for returning the emptied trays to the tray-filling device. In order to deliver the filled tray system fully automatically by a simple transport system without operators, and with the opened top directed downwardly, to the hopper of the packaging machine, the guide rail system of a container-conveying system which is known per se and which has a plurality of the electrically driven travel mechanisms is disposed between a dispatch station which is associated with the tray-filling device, and a receiving station which is associated with the packaging machine. Each of the travel mechanisms carries a receiving container which is designed to receive at least one tray. In the dispatch station, the filled trays are supplied to the receiving container in the normal position and in a horizontal direction; in the receiving station, the filled trays are withdrawn from the receiving container in a position which is rotated relative to the normal position by 180° about a horizontal axis, and in which the open top is directed downwardly.

9 Claims, 6 Drawing Figures

APPARATUS FOR CONVEYING CIGARETTE-FILLED TRAYS TO A CIGARETTE-PACKAGING MACHINE

BACKGROUND OF THE INVENTION

The present invention relates to an apparatus not only for conveying cigarette-filled trays from at least one tray-filling device to the hopper of at least one cigarette-packaging machine, but also for returning the emptied trays to the tray-filling device.

After the production of cigarettes by cigarette-producing machines, and possible finishing thereof by placement of filters on the cigarettes, it is necessary to place the cigarettes in packages. This packaging is effected by cigarette-packaging machines to which the cigarettes which are to be packaged are conveyed via a hopper.

The supply of cigarettes to the hopper of a cigarette-packaging machine is effected either from one or more cigarette-producing machines linked directly with the packaging machine, or with the aid of so-called trays or holders, which are filled in a tray-filling device which is arranged after the cigarette-producing machine. In contrast to the direct supply between manufacturing and packaging machines, the use of trays has the advantage that cigarettes produced on any manufacturing machine can be packaged by any packaging machine which is adapted for the same cigarettes. Furthermore, different outputs and stand-still times of the manufacturing and packaging machines can be balanced in that the trays found in the cycle represent intermediate buffers, and in that possible additional trays can be used for temporarily storing these cigarettes. In this way, upon failure of the manufacturing or filter-applying machines, the packaging machines can be supplied with the cigarettes which are temporarily stored in the trays. Furthermore, the number of manufacturing and packaging machines can be selected in conformity with their individual outputs, so that all of the machines can operate at optimum speeds. Finally, no costs for changing the brand are incurred when the brand is changed for cigarettes having the same size.

Several transport possibilities exist for conveying trays which are filled with cigarettes from the tray-filling device of a cigarette-manufacturing machine to the hopper of a cigarette-packaging machine. Although the trays were formerly transported by hand, nowadays, in addition to so-called endless conveyors with which the trays are transported between the tray-filling devices and the cigarette-packaging machines on the baskets of an overhead conveyor, there exist so-called tray carriages with which a certain number of trays are transported either by hand, by means of a towing vehicle, or by an automatic underfloor load-carrying system.

The drawback to these known transport devices consists in that either an operator or complicated automatic loading systems are required for loading and unloading not only the overhead conveyor baskets but also the tray carriages, because the trays, which are open on one front side and on the top, can be transported in the normal position and only in the horizontal direction, and prior to supply to the hopper of a cigarette-packaging machine must be rotated by 180° about a horizontal axis so that the cigarettes can pass out of the tray into the hopper.

It is an object of the present invention to provide an apparatus for not only conveying cigarette-filled trays from at least one tray-filling device to the hopper of at least one cigarette-packaging machine, but also for returning the emptied tray to the tray-filling device, which apparatus operates fully automatically without operators, yet has a simple transport system, and which delivers the filled trays to the hopper with the open top directed downwardly.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
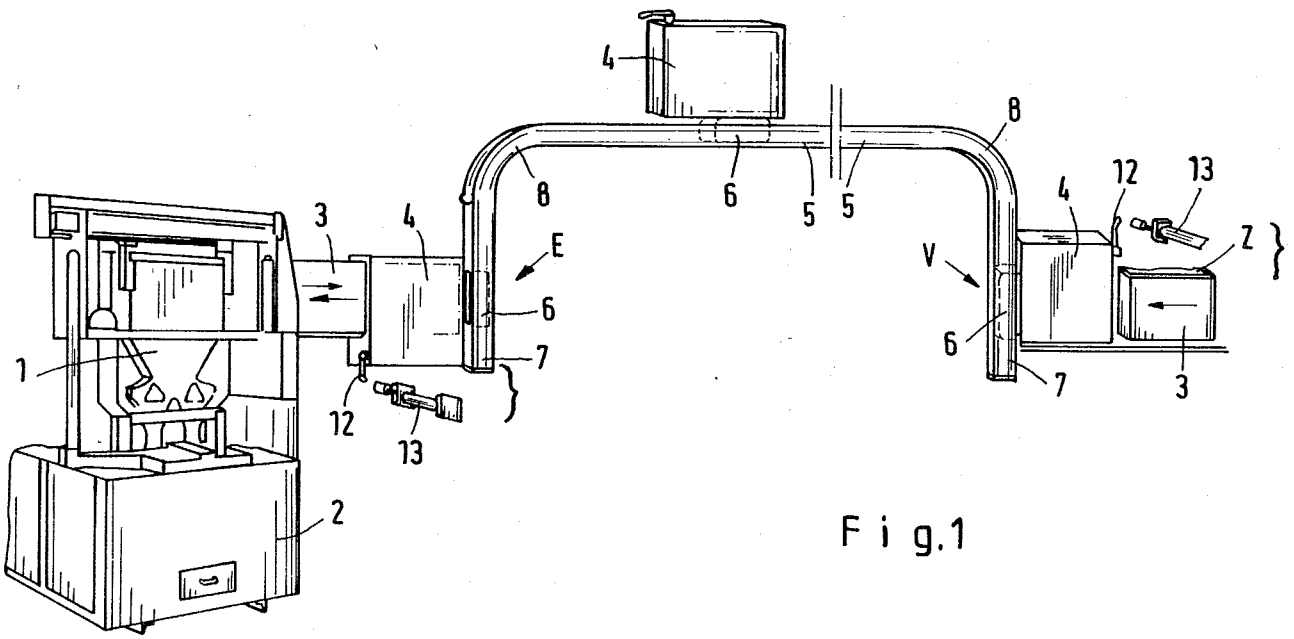
FIG. 1 is a schematic illustration of one embodiment of the inventive apparatus showing the principle thereof.

The apparatus of the present invention is characterized primarily in that the guide rail system of a receptacle-conveying system, which is known per se and which has a plurality of electrically driven travel mechanisms, is disposed between a dispatch station which is associated with the tray-filling device, and a receiving station, which is associated with the packaging machine. Each of the travel mechanisms carries a receiving container which is designed to receive at least one tray. In the dispatch station, the filled trays are supplied to the receiving container in the normal position and in the horizontal direction; in the receiving station, the filled trays can be withdrawn from the receiving container in a position which is rotated by 180° about a horizontal axis relative to the normal position, and which has the open top directed downwardly.

With the proposal pursuant to the present invention, the advantage is achieved that the filled trays can be transferred in a simple manner in the dispatch station out of the tray-filling device into the receiving container, and that these trays arrive in the receiving station in a position which is rotated by 180° relative to the normal position, so that the expensive pivoting process, which can lead to disruptions, in the region of the hopper of the cigarette-packaging machine is eliminated. As a result, it is possible to convey one or more trays at the same time with each receiving container, and in fact independently of whether the trays are disposed parallel or transverse to the direction of travel of the travel mechanism within the receiving container.

Pursuant to a further feature of the present invention, the guide rail system includes at least one side rail for returning the empty trays from the receiving station to the tray-filling device. Furthermore, the guide rail system can be disposed between the tray-filling devices of a plurality of cigarette-manufacturing machines, and the hoppers of a plurality of cigarette-packaging machines, and can be equipped with computer-controlled routing means for the travel mechanisms, which are controlled with regard to destination, so that all of the machines can operate at their respectively optimum speeds, and possible standstill times of individual machines can be compensated for.

Preferably, the guide rail system is disposed above the cigarette-manufacturing and packaging machines, and includes at least two curved sections, each of which is curved by 90° about an approximately horizontal axis, for the rotation of the position of the receiving container between the dispatch and receiving stations, so that on the one hand special pivoting apparatus for the trays are eliminated, and the inventive apparatus has no special space requirement, which in the cigarette industry is only present to a limited extent.

In order to avoid tumbling about of the cigarettes located in the trays during the pivot process, it is proposed pursuant to a further feature of the present invention that each receiving container be equipped with a holding device which fixes the position of the uppermost layer of these cigarettes located in the filled tray.

Pursuant to a preferred embodiment of the present invention, this holding device includes a plurality of pressure plates, which are disposed parallel to the cigarettes, the contact surface of which can be lowered upon the cigarettes of the uppermost layer in the dispatch station, which in the receiving station can be returned to their starting position, and which can be secured in both positions.

It is finally proposed pursuant to the present invention that the pressure plates be movable in the dispatch and receiving stations by the force of gravity, and be securable on their opposite side surfaces by means of a pair of spring-loaded clamping levers or strips, which in the dispatch and receiving stations can, by means of an actuating lever, be brought out of engagement with the pressure plates. Preferably, the pressure plates are essentially T-shaped and have toothed side surfaces.

DESCRIPTION OF PREFERRED EMBODIMENTS

Referring now to the drawings in detail, FIG. 1 shows in a schematic illustration the hopper 1 of a cigarette packaging machine 2, which is only schematically illustrated. The cigarettes which are to be packaged are supplied to the hopper 1 by means of trays or holders 3. In the illustrated embodiment, these trays 3 are individually transported in receiving containers 4 of a container conveying system, the guide rail system 5 of which is shown in FIG. 1. Electrically operated travel mechanisms 6, each of which carries a receiving container 4, travel in the rails of this guide rail system 5. In the illustrated embodiment, these receiving containers 4, and hence the trays 3 transported by them, are disposed parallel to the direction of travel of the travel mechanisms 6. It is, of course, also possible to dispose the receiving containers 4 on the travel mechanisms 6 transverse to the direction of travel of the latter, as well as to simultaneously transport a plurality of trays 3 in one receiving container 4.

The trays 3 are filled with cigarettes in a tray-filling device which is arranged after a cigarette-manufacturing machine. The tray-filling device and the cigarette-manufacturing machine are not shown in the drawings. However, FIG. 1 shows a filled tray 3. This tray 3 has a bottom, two end walls, and a front side, with the other wide side and the top of the tray 3 being open, so that the uppermost position of the cigarettes Z can be seen in that tray 3 located on the right side of FIG. 1.

These trays 3, when they are filled with cigarettes Z, are, in the illustrated normal position, introduced into the receiving container 4 in the horizontal direction when the container 4 is located in the dispatch station V. In the illustrated embodiment, this station V is formed by a vertical rail section 7, which is connected to the guide rail system 5 by means of a curved section 8 which has a 90° curve. In the dispatch station V which is formed in this manner, the open side of the receiving container 4 is directed toward the filled tray 3 which is to be introduced horizontally, so that the tray 3 can be easily inserted into the receiving container 4 without difficulty.

The filled tray 3 located in the storage or receiving container 4 is subsequently conveyed via the guide rail system 5 to a receiving station E, which also comprises a vertical rail section 7 which is connected to the guide rail system 5 by means of a curved section 8 which has a 90° curve. The guide rail system 5 itself is only illustrated in a simplified manner in FIG. 1, and can extend over considerable distances. It can also include various routing means, for example if a plurality of cigarette-manufacturing machines are connected with a plurality of cigarette-packaging machines 2 via the guide rail system 5 of the container conveying system.

By means of the two curved sections 8, the receiving container 4, during its movement from the dispatch station V to the receiving station E, rotates about a horizontal axis by 180°, so that in the receiving station E the open top of the filled tray 3 is directed downwardly. Thus, as it is transferred to the cigarette-packaging machine 2, the filled tray 3 is located in a position rotated by 180° to the normal position; in this position, the open top of the tray 3 is directed downwardly. Thus, it is merely necessary to horizontally move the filled tray 3 out of the receiving container 4 which is located in the receiving station E, and to transport the tray 3 over the hopper 1 of the packaging machine 2 in order to supply the cigarettes Z to the packaging machine 2. During the transfer of the tray 3, with the open top directed downwardly, out of the receiving container 4 and over the hopper 1, the only requirement is that the cigaretts Z cannot fall out of the tray. For this purpose, it suffices to shift the tray 3 over a closed guideway which also spans the upper side of the hopper 1 and is only opened when the cigarettes Z are to be transferred out of the tray 3 into the hopper 1.

The schematically illustrated guide rail system 5 of the container conveying system includes at least one non-illustrated side rail over which the empty tray 3 can be returned from the receiving station E to the dispatch station V in the vicinity of the tray filling device. As previously mentioned, not shown in the drawings are routing means, branch lines, and siding rails for temporarily storing filled trays 3. These are known components of a container conveying system, and were omitted for simplification of the drawings; similarly omitted were the control elements which make possible the delivery of filled trays 3 from any dispatch station V to any receiving station E, as well as the temporary storage of the filled trays 3 on a sort of side rail or in an intermediate storage area.

So that the cigarettes Z located in the tray 3 cannot tumble about within the receiving container 4 during transport, each container 4 is equipped with a holding device by means of which the uppermost layer of the cigarettes Z located in the filled tray are secured into position during the transport. One embodiment of such a holding device is illustrated in FIGS. 2–6.

Figures 2, 3, 4:
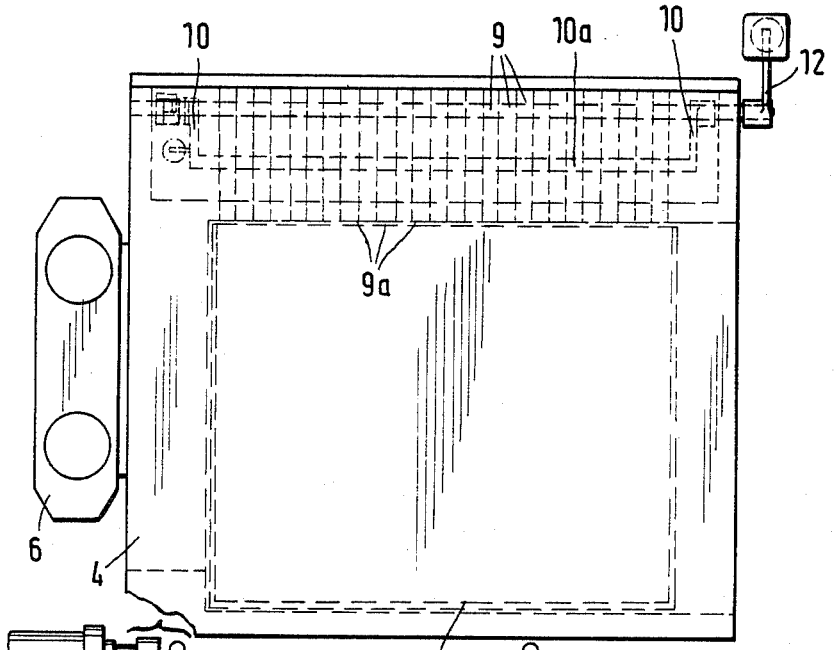
FIG. 2 is a side view of a receiving container arranged on a travel mechanism, and shows a holding device in the starting position.
FIG. 3 is an end view of the upper portion of the receiving container of FIG. 2.
FIG. 4 is an end view in conformity with that of FIG. 3, however shows the holding device in the operating position.
Figure 5:
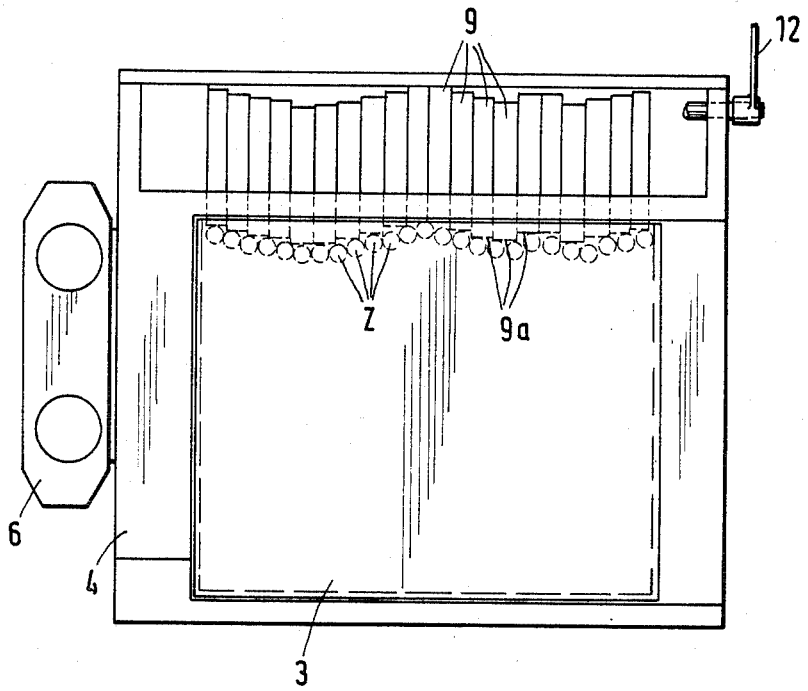
FIG. 5 is a side view in conformity with that of FIG. 2, with the holding device in the operating position.
Figure 6:
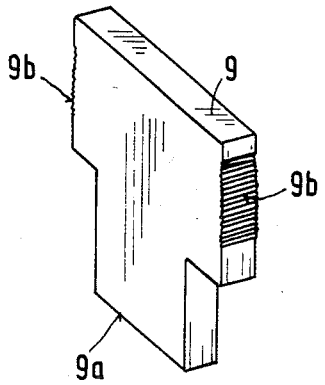
FIG. 6 is an isometric view of a pressure plate.

In the illustrated embodiment, the holding device comprises a plurality of pressure plates 9 which, as shown in FIG. 6, are essentially T-shaped; their contact surfaces 9*a* can act on the uppermost layer of cigarettes Z, as shown in FIGS. 4 and 5. For this purpose, the pressure plates 9 are lowered by the force of gravity out of the starting position illustrated in FIGS. 2 and 3 onto the cigarettes Z as soon as a filled tray 3 is located in the receiving container 4. The operating position of the pressure plates 9 produced in this manner is shown in FIGS. 4 and 5.

In order to hold the pressure plates 9 in this operating position during transport of the receiving container 4, a pair of clamping levers 10 are disposed in the latter. The projecting clamping strips 10*a* of the clamping levers 10 act on the toothed side surfaces 9*b* of the pressure plates 9. The clamping strips 10*a* are pulled toward one another by at least one tension spring 11, so that during the entire transport the pressure plates 9 remain in the formerly assumed operating position.

As soon as the filled tray 3 in the receiving station E is to be withdrawn from the receiving container 4, the clamping strips 10*a* are moved apart against the force of the tension spring 11. This is achieved by pivoting the clamping levers 10, which are coupled with one another by means of a connecting lever 10*b*, by means of an actuating level 12, for example with the aid of a stationarily mounted actuating cylinder 13. As soon as the clamping strips 10*a* are no longer in engagement with the side surfaces 9*b* of the pressure plates 9, the latter return to their starting position due to the force of gravity, since the receiving container 4 is in an upside-down position in the receiving station E. The pressure plates 9 thus assume their starting position, illustrated in FIGS. 2 and 3, in which they are again held firmly in place by the clamping strips 10*a* as soon as the actuating lever 12 returns to its normal position, because also the piston rod of the actuating cylinder 13 is returned to its starting position.

The trays 3, which in the receiving station E arrive in a position which is rotated by 180° relative to the normal position, can thus without difficulty be shifted and emptied over the hopper 1 of the packaging machine 2. After the empty trays 3 have been returned to the receiving container 4, the return transport of the latter to the dispatch station V is effected. This is effected by means of a non-illustrated side rail in order not to obstruct the supply of further filled trays 3 to the packaging machine 2.

The present invention is, of course, in no way restricted to the specific disclosure of the specification and drawings, but also encompasses any modifications within the scope of the appended claims.

What we claim is:

1. An apparatus for conveying cigarette-filled, open-topped trays from at least one tray-filling device to the hopper of at least one cigarette-packaging machine, and for returning the emptied trays to said tray-filling devices; said apparatus comprises:

a dispatch station associated with said tray-filling devices;

a receiving station associated with said cigarette-packaging machines;

a container-conveying system, which is disposed between said dispatch station and said receiving station, and which includes an essentially U-shaped guide rail system and a plurality of electrically driven travel mechanisms which respectively travel in said guide rail system; and a plurality of receiving containers, with each of said travel mechanisms carrying one of said receiving containers, each of which, in turn, receives at least one of said trays; said U-shaped guide rail system conveys said travel mechanisms, and hence said receiving containers, from said dispatch station to said receiving station, whereby as a result of said U-shape of said guide rail system, filled trays are received by said receiving containers at said dispatch station in a normal position, with said open tops thereof directed upwardly, and are ready for withdrawal from said receiving containers at said receiving station in a position which is rotated by 180° from said normal position, and in which said open tops of said trays are directed downwardly.

2. An apparatus according to claim 1, in which said guide rail system includes at least one side rail for effecting return of emptied trays from said receiving station to said tray-filling devices.

3. An apparatus according to claim 1, in which said guide rail system is disposed between the tray-filling devices of a plurality of cigarette-manufacturing machines, and the hoppers of a plurality of cigarette-packaging machines, and is equipped with computer-controlled routing means for said travel mechanisms, which are controlled with regard to their destination.

4. An apparatus according to claim 1, in which said U-shaped guide rail system is disposed above cigarette-manufacturing and packaging machines, and includes at least two curved sections, each of which is curved by 90° in order to provide said U-shape; said curved sections effecting said 180° rotation of the position of said trays between said dispatch and receiving stations.

5. An apparatus according to claim 4, in which each of said receiving containers is equipped with a holding device for holding in position the uppermost layer of cigarettes in said filled trays.

6. An apparatus according to claim 5, in which said holding device comprises a plurality of pressure plates, which are disposed parallel to said cigarettes; each of said pressure plates is provided with a contact surface, which in said dispatch station are lowered onto the cigarettes of the uppermost layer of cigarettes, and in said receiving station are returned to their starting position; said holding device further comprises means to selectively secure said pressure plates in either their starting position or their lowered position.

7. An apparatus according to claim 6, in which said pressure plates are shifted in said dispatch and receiving stations by the force of gravity; in which each pressure plate has opposite side surfaces; in which said means to selectively secure said pressure plates includes a pair of spring-loaded clamping strips associated with said opposite side surfaces of each of said pressure plates; and which includes actuating lever means for bringing said clamping strips out of engagement with said side surfaces of said pressure plates in said dispatch and receiving stations.

8. An apparatus according to claim 7, in which said pressure plates are essentially T-shaped, and in which said side surfaces thereof are toothed side surfaces.

9. An apparatus according to claim 6, which includes a closed guideway which is associated with said receiving station for closing-off said open top of a given tray when the latter is withdrawn from its receiving container.

* * * * *